United States Patent [19]

Hoene

[11] Patent Number: 4,717,797

[45] Date of Patent: Jan. 5, 1988

[54] CONTACT ARRANGEMENT FOR A VACUUM SWITCHING TUBE

[75] Inventor: Ernst-Ludwig Hoene, Berlin, Fed. Rep. of Germany

[73] Assignee: Siemens Aktiengesellschaft, Berlin and Munich, Fed. Rep. of Germany

[21] Appl. No.: 788,570

[22] Filed: Oct. 17, 1985

[30] Foreign Application Priority Data

Dec. 18, 1984 [DE] Fed. Rep. of Germany ..... 3446170

[51] Int. Cl.[4] ..... H01H 33/66

[52] U.S. Cl. ..... 200/144 B

[58] Field of Search ..... 280/144 B

[56] References Cited

U.S. PATENT DOCUMENTS

| | | | |
|---|---|---|---|
| 4,117,288 | 9/1978 | Gorman et al. | 200/144 B |
| 4,196,327 | 4/1980 | Kurosawa et al. | 200/144 B |

FOREIGN PATENT DOCUMENTS

| | | | |
|---|---|---|---|
| 2546376 | 6/1976 | Fed. Rep. of Germany | 200/144 B |
| 3151907 | 6/1983 | Fed. Rep. of Germany | 200/144 B |
| 2520927 | 8/1983 | France | 200/144 B |
| 1345693 | 1/1974 | United Kingdom | 200/144 B |

*Primary Examiner*—Robert S. Macon

[57] ABSTRACT

For generating an axial magnetic field, conductor loops are disposed behind the contact members in vacuum switching tubes. The terminals of these conductor loops are supported in axial direction by supporting parts having poor electrical conductivity. In order to reduce the mass of these conductor loops, it is provided that the supporting part be dimensioned such that it represents an electrical shunt to the adjoining conductor loop the electrical conductance of this shunt amounting to at least ¼ of the electrical conductance of the conductor loop, the invention is suitable for axial field contacts comprising at least one conductor loop disposed behind the contact member.

8 Claims, 8 Drawing Figures

CONTACT ARRANGEMENT FOR A VACUUM SWITCHING TUBE

BACKGROUND OF THE INVENTION

1. Field of the Invention

The present invention relates to a contact arrangement for a vacuum switching tube.

2. Description of the Prior Art

German OS No. 31 51 907 discloses contact arrangement for a vacuum switching tube wherein two contact members contacting one another at their end faces and wherein at least one conductor loop which lies at the side of a contact member facing away from the cooperating contact, are traversed by a part of the current to be switched and thereby generate a magnetic field in the direction of the contact axis. The current is conducted by corresponding webs from a stud to a ring-shaped part or, given a plurality of conductor loops, a ring-sector-shaped part of the conductor loops and is conducted from this latter part via a further web to a contact surface of the contact member close to the axis. The ring-sector-shaped parts augment one another to form a ring, whereby a respective terminal of the conductor loops is connected electrically conductive in low resistant fashion to the stud or to the contact surface of the contact member, but is supported in axial direction at the opposite side by a supporting part of electrically poorly conductive material, and whereby the supporting part represents a shunt to the conductor loop. The conductor loop represents a complete circular ring separated only by an oblique gap. Conductor loops which cover only a part of the circumference of a circular ring are disclosed by U.S. Pat. No. 4,196,327. Although the use of adaptors of rust-resistant steel is mentioned in these known embodiments, these should merely be poorly conductive so that practically the full current flows via the conductor loops.

SUMMARY OF THE INVENTION

An object of the present invention is to construct such contacts with lower mass while maintaining the same making and/or breaking capacity in order to manage with lower accelerating forces for the switching events during drive of the switch.

In a contact arrangement as described above, this object is achieved by having the conductance of the supporting part amounting to at least ¼ of he conductance loop or the sum of the conductances of all conductor loops adjoining the supporting part.

The invention is based on the discovery that a diffuse arc can be generated during the switching event by an axial magnetic field whose strength is significantly less than the magnetic field generated by the full current to be switched in a winding, independently of the current to be switched.

It is advantageous for an optimally far reaching exploitation of the contact surface on the contact member when a circular ring-shaped conductor loop is provided whose two terminals and webs lie above one another and are separated from one another by a slot inclined relative to the rotational axis of the contact, a supporting part being attached in the slot for increasing the mechanical stability. A mechanically stable embodiment of the supporting part results when it is circular ring-shaped and is composed of a rust resistant steel whose specific electrical resistance is higher by about a factor of 40 than that of the material of the conductor loop, usually copper. This is achieved, for example, in that the circular ring-shaped supporting part is dimensioned such that its outside diameter amounts to about 0.7 and its inside diameter to about 0.5 times the diameter of the stud and in that the cross-section of the conductor loop amounts to about half the cross-section of the stud and that the thickness of the supporting part makes up about 0.5% of the length of the conductor loop.

The mean path from the edge of the stud up to the edge of the contact surface at the contact member is to be established as the length of the conductor loop in the present application. Correct values are thereby obtained with adequate approximation, even in view of the relatively complicated current paths in a contact of the described form.

In the referenced prior art, the current through the conductor loops is diminished insofar as two or more loops disposed following one another in circumferential direction are formed. In those arrangements, the current divides based on the number of conductor loops. Regions without axial magnetic field thereby arise, particularly over the webs leading to the stud; a diffuse arc can thus form only on a part of the contact surfaces on the contact members. An optimally far reaching exploitation of the contact surfaces of the contact members, however, is desired for high braking currents. The present invention can be advantageously employed, particularly in such instances. It is also excellently suited for an optimally precise matching of the load of a known conductor loop configuration to the required minimum field strength in axial direction.

BRIEF DESCRIPTION OF THE DRAWINGS

The invention shall now be explained in greater detail with reference to the figures.

DESCRIPTION OF THE PREFERRED EMBODIMENTS

Figure 1:
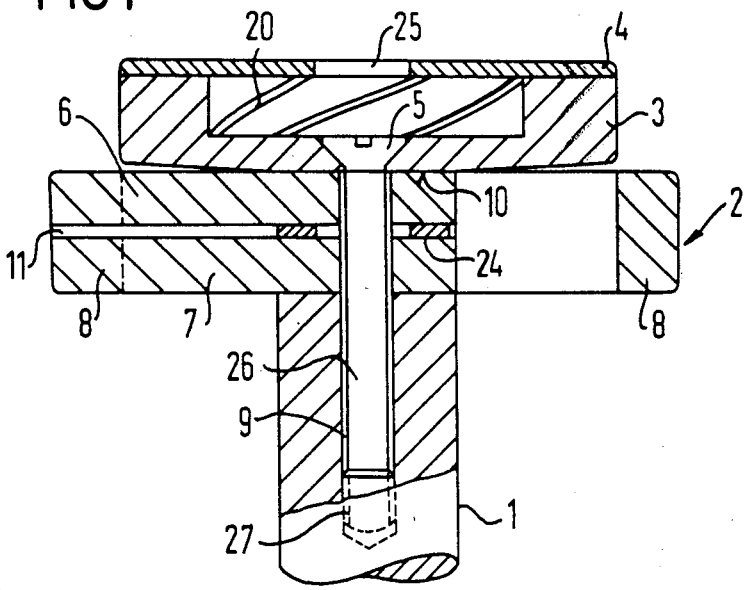
FIG. 1 shows a contact of the invention in a partially sectional and elevational view.
Figure 1A:
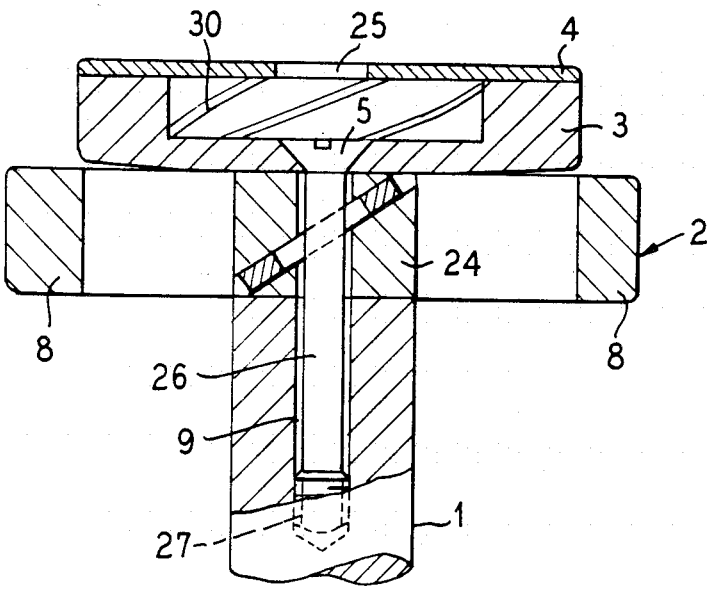
FIG. 1A shows the contact of FIG. 1 in a partially sectional and elevational view, rotated 90° from the showing of FIG. 1.

FIG. 1 and 1A illustrate a contact arrangement embodying the principles of the present invention wherein a conductor loop 2 is put in place on a stud 1 and a contact member 3 is put in place on the conductor loop 2, whereby the contact member 3 is fashioned as a pot contact having a contact plate 4. The contact plate 4 contains a concentric recess 25 through which a screw 5 is inserted, the screw pressing the contact member 3 and the conductor loop 2 against the end face of the stud 1. The screw 5 comprises a shank 26 having a relatively small diameter, so that this shank 26 does not come into contact with a bore 9. The bore 9 has a thread 27 only in its end region, the thread of the screw 5 being screwed thereto. The screw 5 is composed of a material having low electrical conductivity, for example of rust-resistant steel. The electrical shunt from the stud 1 via the screw 5 to the contact member 3 is negligibly low because of the great length of the screw 5 and the high resistance connected therewith.

The conductor loop 2 has an annular part 8 and radially disposed webs 6 and 7. The annular part 8 and the webs 6 and 7 are separated by a common, planar slot 11 which is inclined relative to the rotational axis of the contact. As a consequence thereof, the current coming from the stud is partially conducted via the web 7, the ring 8 and the web 6 to a contact surface 10a of the contact member 3. A considerable part of the current, however, is conducted through a circular ring-shaped supporting part 24. The supporting part can be fashioned as an elliptical ring in the inclined slot of the shown embodiment and can be adapted to the inclined position of the slot. In most cases, however, the employment of a circular ring-shaped supporting part suffices, whereby the inside diameter of the circular ring is selected so much greater than the bore 9 that the screw 5 can be easily introduced into the bore 9 despite the inclined type of installation.

As a preferred dimensioning example, a supporting ring composed of a rust resistant steel can be employed whose specific resistance resistivity is about 40 times greater than the specific resistance resistivity of the material of the conductor loop 8. Such a supporting ring could have the following dimensions given a mean diameter of the conductor loop of 96 mm: outside diameter 27 mm, inside diameter 14 mm, height 2.3 mm.

Figure 2:
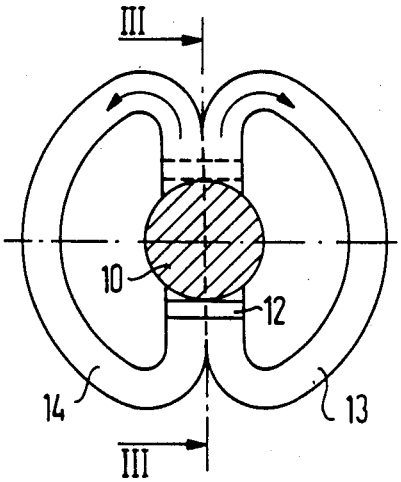
FIG. 2 is an end view of a conductor loop.
Figure 3:
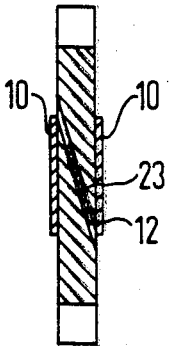
FIG. 3 is a side sectional view of the loop taken generally along the line III—III of FIG. 2.

FIGS. 2 and 3 show two conductor loops of a switch contact which cover a semi-circle. The conductor loops comprise common terminal surfaces 10 for the stud or the contact member. A slot 12 inclined relative to the rotational axis of the contact separates the two contact surfaces 10 from one another and divides the conductor loops 13, 14, so that one part of the current to be switched flows through these conductor loops 13, 14. A supporting part 23 is inserted into the slot, absorbs the pressure in axial direction and represents a shunt to the conductor loops 13, 14. The supporting part 23 is shown as a disk; however, it can also have other forms. Dependent on the desired mechanical configuration and pressure distribution, the form of a hollow rectangle or square or circular ring can be advantageous for the supporting part.

Figure 4:
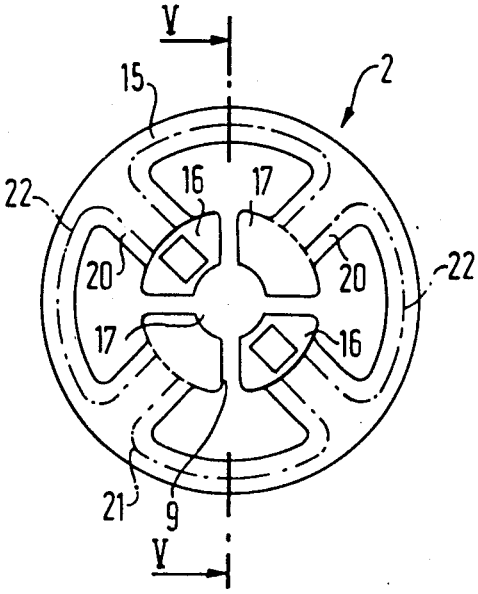
FIG. 4 is an end view of an alternate arrangement of a conductor loop.
Figure 5:
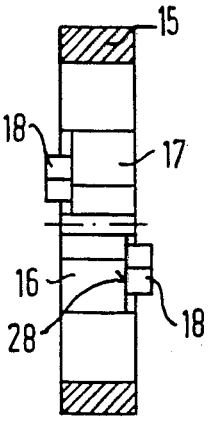
FIG. 5 is a side sectional view of the loop taken generally along the line IV—IV of FIG. 4.

FIGS. 4 and 5 show an exemplary embodiment comprising four conductor loops 21, 22 whose parts remote from the axis augment one another to form a ring and are integrally connected via webs 20 to terminals 16, 17, whereby supporting parts 18 are inserted in recesses 28 of the terminals 16, 17. The supporting parts 18 project beyond the adjacent contact surfaces of the terminals 16, 17. These supporting parts 18 are advantageously inserted in recesses of the adjoining end face of the stud or contact surfaces of the contact member, whereby only their end faces touch the recesses and whereby the depth of the recesses precisely corresponds to the height of the supporting parts 18 projecting beyond the neighboring terminals. A contacting without a bending of the conductor loops is thereby possible.

Figure 6:
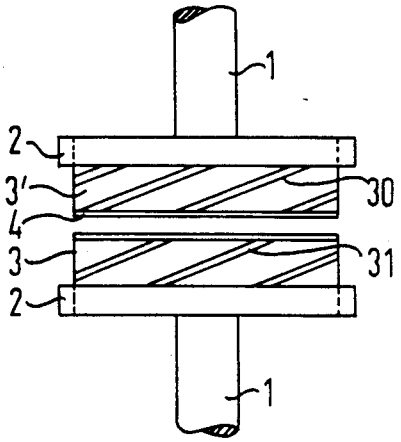
FIG. 6 is a side elevational view of a contact arrangement.

FIG. 6 shows a contact arrangement wherein a stud 1 is connected to a conductor loop 2 and to a contact member 3 or 3'. In its cylinder walls, the contact member 3 has slanting slots 31 which have the same direction of inclination in the contact arrangement as the inclined slots 30 in the cylinder wall of the contact member 3'. In this embodiment, an axial magnetic field is generated by the slots 30 or 31 in the walls of the pot contact, this axial magnetic field then being additionally intensified by the conductor loops 2. Relatively low currents therefore suffice in the conductor loops 2 in this embodiment. Accordingly, the shunt which is formed by a supporting part as in FIG. 1 can be of relatively low resistance; the conductance of the supporting part can be advantageously 1× through 4× the size of the conductance of the conductor loop. Accordingly, the conductor loops herein can be fashioned with a relatively small cross-section.

The conductor loops 2 comprise a larger diameter than the contact members 3, 3'; their inside diameter is preferably just as large as the outside diameter of the contact members. In this case, the axial magnetic field is attracted into the walls of the contact members, so that the surface of the contact plates 4 can be completely exploited for the arc discharge.

Figure 7:
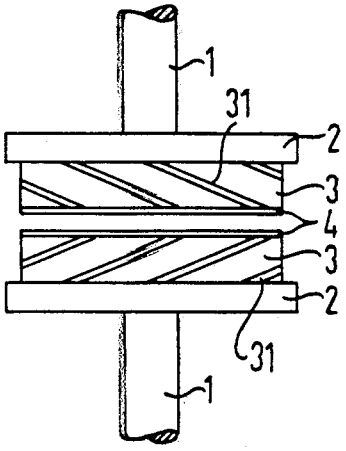
FIG. 7 is a side elevational view of an alternate arrangement of a contact.

FIG. 7 shows an embodiment wherein the slots 31 in the cylinder walls of the contact members 3 are inclined in opposite direction with reference to the common rotational axis of the contact arrangement. This embodiment generates a rotation of the arc, so that the arc kept diffuse by the axial magnetic field also rotates. In this case, the two contact members 3 are identically constructed; i.e., as seen from the end face of the cylinder wall, the slots 31 in the contact members 3 always exhibit the same direction of inclination relative to the rotational axis of the individual contact. This is advantageous for manufacture, since only one kind of contact member is required here.

Instead of the pot contacts shown in the FIGS., other contact shapes, particularly plate contacts, can also be utilized. The latter are advantageous because of their slight extent in axial direction, particularly in combination with more than two conductor loops as, for example, shown in FIGS. 4 and 5. Given employment of only one conductor loop, the conductance of the supporting member advantageously amounts to a maximum of 4 times the conductance of the conductor loop.

Thus, it is seen that the present invention provides an improvement in a contact arrangement of a vacuum switching tube wherein two contact members 3 contacting one another at their end faces 4 and wherein at least one conductor loop 2 which lies at the side of the contact member 3 facing away from the cooperating contact 4 are transversed by a part of the current to be switched and thereby generate a magnetic field in the direction of the contact axis, the current being conducted by corresponding webs 7 (FIG. 1), unnumbered (FIG. 2), 20 (FIG. 4) from the stud 1 to a ring-shaped part 8 (FIG. 1) or a ring-sector shaped part 13, 14 (FIG. 2), 21, 22 (FIG. 4) and being conducted from the ring-shaped part or parts via a further web 6 (FIG. 1), unnumbered (FIG. 2), 20 (FIG. 4) to a contact surface 10 of the contact member 3 close to the axis, a respective terminal of the conductor loops being connected electrically conductive in low resistant fashion to the stud or to the contact surface of the contact member, but being supported in axial direction at the opposite side by a supporting part 24 (FIG. 1), 23 (FIG. 3) or 18 (FIG. 5) of electrically poorly conductive material, and the supporting part representing a shunt to the conductor loop, wherein a conductance of the supporting part 24, 23, 18 amounts to at least one quarter and up to four times the conductance of the conductor loop or sum of the loops.

As is apparent from the foregoing specification, the invention is susceptible of being embodied with various alterations and modifications which may differ particularly from those that have been described in the preceeding specification and description. It should be understood that I wish to embody within the scope of the patent warranted hereon all such modifications as reasonably and properly come within the scope of my contribution to the art.

I claim as my invention:

1. In a contact arrangement of a vacuum switching tube wherein two contact members contacting one another at their end faces and wherein at least one conductor loop which lies at the side of a contact member facing away from the cooperating contact are traversed by a part of the current to be switched and thereby generate a magnetic field in the direction of the contact axis, said current being conducted by corresponding webs from the stud to a ring-shaped part and being conducted from said ring-shaped part via a further web to a contact surface of the contact member close to the axis, a respective terminal of the conductor loops being connected electrically conductive in low resistant fashion to the stud or to the contact surface of the contact member, but being supported in axial direction at the respectively opposite side by a supporting part of electrically poorly conductive material, and said supporting part representing a shunt to the conductor loop, the improvement comprising a conductance of the supporting part amounting to at least ¼ of the conductance of the conductor loop.

2. A contact arrangement according to claim 1, wherein only one conductor loop which represents a full winding around the stud is provided; cup contacts having a slotted cylinder wall are provided as contact members; the slots are inclined in different direction with respect to the common rotational axis of the two contacts, being thus inclined in order to promote the rotation of the arc; and the conductance of the supporting part is up to twice as great as the conductance of the conductor loop.

3. A contact arrangement according to claim 1, wherein only one conductor loop representing a full winding around the stud is provided; pot contacts having a slotted cylinder wall are provided as contact members; the slots of both contact members are inclined in the same direction relative to their common symmetry axis; and in that the electrical conductance of the supporting member corresponds to 1× through 4× the conductance of the conductor loop.

4. A contact arrangement according to claim 1, wherein a circular ring-shaped conductor loop is provided whose two terminals and webs lie above one another and are separated from one another by a slot inclined relative to the rotational axis of the contact.

5. A contact arrangement according to claim 4, wherein the supporting part is circular ring-shaped and is composed of a rust resistant steel whose electrical conductivity is lower by about a factor of 40 than the electrical conductivity of the material of the conductor loops.

6. A contact arrangement according to claim 5, wherein the circular ring-shaped supporting part is dimensioned such that its outside diameter amounts to 0.7 times the diameter of the stud and its inside diameter amounts to 0.5 times the diameter of the stud; the cross-section of the conductor loop amounts to about half the cross-section of the stud; and the thickness of the supporting part makes up about 0.5% of the length of the conductor loop.

7. A contact arrangement according to claim 1, wherein only one conductor loop is provided; a plate contact serves as contact member; and the conductance of the supporting part amounts up to four times the conductance of the conductor loop.

8. In a contact arrangement of a vacuum switching tube wherein two contact members contacting one another at their end faces and wherein a plurality of conductor loops which lie at the side of a contact member facing away from the cooperating contact are traversed by a part of the current to be switched and thereby generate a magnetic field in the direction of the contact axis, said current being conducted by corresponding webs from the stud to a ring-sector-shaped part of the conductor loops and being conducted from said ring-sector-shaped part via a further web to a contact surface of the contact member close to the axis, said ring-sector-shaped parts augmenting one another to form a ring, a respective terminal of the conductor loops being connected electrically conductive in low resistant fashion to the stud or to the contact surface of the contact member, but being supported in axial direction at the respectively opposite side by a supporting part of electrically poorly conductive material, and said supporting part representing a shunt to the conductor loop, the improvement comprising a conductance of the supporting part amounting to at least ¼ of the sum of the conductances of all conductor loops adjoining the supporting part.

* * * * *